US005339640A

United States Patent [19]

Reinke

[11] Patent Number: 5,339,640

[45] Date of Patent: Aug. 23, 1994

[54] HEAT EXCHANGER FOR A THERMOACOUSTIC HEAT PUMP

[75] Inventor: Michael J. Reinke, Franklin, Wis.

[73] Assignee: Modine Manufacturing Co., Racine, Wis.

[21] Appl. No.: 995,808

[22] Filed: Dec. 23, 1992

[51] Int. Cl.[5] ..... F25B 1/00

[52] U.S. Cl. ..... 62/6; 165/153; 165/173

[58] Field of Search ..... 165/148, 152, 153, 163, 165/176; 62/515, 6

[56] References Cited

U.S. PATENT DOCUMENTS

| | | | |
|---|---|---|---|
| 2,052,569 | 9/1936 | Truelsen | 165/163 X |
| 2,260,594 | 10/1941 | Young | 165/176 |
| 2,399,357 | 4/1946 | Koper | 165/176 |
| 2,461,409 | 2/1949 | Christensen | 165/163 |
| 2,657,018 | 10/1953 | Simpelaas | 165/163 X |
| 2,970,812 | 2/1961 | Kritzer | 62/515 X |
| 3,118,498 | 1/1964 | Bergdoll | 165/173 |
| 3,404,731 | 10/1968 | Cushman | 165/163 X |

OTHER PUBLICATIONS

Reprint from Technology 2001: The Second National Technology Transfer Conference and Exposition, Dec. 5, 1991, San Jose, Calif. (Steven L. Garrett and Thomas J. Hofler).

The Natural Heat Engine-Reprinted from Los Alamos Science, #14, Fall 1986 (John C. Wheatley, Gregory W. Swift, and Albert Migliori).

NASA-Lyndon B. Johnson Space Center "ThermoAcoustic Life Sciences Refrigerator".

*Primary Examiner*—Allen J. Flanigan

*Attorney, Agent, or Firm*—Wood, Phillips, VanSanten, Hoffman & Ertel

[57] ABSTRACT

The efficiency of a thermoacoustic device including a gas-filled, elongated resonator tube (10), an acoustic driver (16) and a tube (10) for establishing a standing wave therein, an elongated stack (20) within the tube (10) having opposite (24, 26) spaced from the driver (16) can be increased with first and second heat exchangers (28, 30) in proximity to the stack (20) at each end (24, 26) thereof where each of the heat exchangers comprises at least one tube (56, 70) formed into a plurality of spaced runs (58, 60, 62, 64, 66, 68, 72, 74, 76, 78, 80, 82). The tubes (56, 70) have an inlet (96) and an outlet (102) spaced therefrom and fins (94) are bonded to the tubes (56, 70) in the spaces between the runs (58, 60, 62, 64, 66, 68, 72, 74, 76, 78, 80, 82).

11 Claims, 2 Drawing Sheets

HEAT EXCHANGER FOR A THERMOACOUSTIC HEAT PUMP

FIELD OF THE INVENTION

This invention relates to heat exchangers, and more specifically, for heat exchangers useful in thermoacoustic heat pumps.

BACKGROUND OF THE INVENTION

Thermoacoustic heat pumps (sometimes also referred to as thermoacoustic engines) have evoked considerable interest within the last decade, no doubt because of their relative simplicity and lack of moving parts. For example, a typical thermoacoustic heat pump requires but a single moving part in the form of a loud speaker or driver. The remainder of the pump includes a resonator tube, a so-called "stack," a hot side primary heat exchanger and a cold side primary heat exchanger. The loud speaker or driver sets up a standing wave within the resonator tube with the consequence that a gas therein is ideally alternately compressed and expanded adiabatically.

This, in turn, causes heat to be transferred from one end of the stack to the other. Thus, the temperature at one end of the stack will be lower than the temperature at the other end of the stack and through the use of the primary heat exchangers, a heat transfer fluid can be cooled or heated, depending upon the end of the stack at which the heat exchange fluid is flowing.

A number of publications deal with this type of apparatus. See, for example, Los Alamos Science, Number 14, Fall of 1986 and the article therein entitled "*The Natural Heat Engine*" by John C. Wheatley et al, the details of which are herein incorporated by reference. Also of some interest is a report prepared for the National Aeronautics and Space Administration under Job Order JSC-3P1-068, Contract No. NAS9-17884 to GE Government Services by Dr. Steven Garrett and entitled "*Thermoacoustic Life Sciences Refrigerator—A Preliminary Design Study*". As pointed out in the latter, a number of technologies employed in the analysis are relatively well understood but the weakest portions deal with the primary and secondary heat exchangers. The author concludes that it is possible to improve efficiency substantially through improvements in the heat exchangers; and the present invention is directed to accomplishing that goal.

SUMMARY OF THE INVENTION

It is the principal object of the invention to provide a new and improved heat exchanger. More specifically, it is an object of the invention to provide a new and improved heat exchanger that is ideally suited for use as a primary heat exchanger in a thermoacoustic heat pump.

An exemplary embodiment of the invention achieves the foregoing object in a construction including the combination of a gas-filled, elongated, resonator tube provided with an acoustic driver for establishing a standing wave within the tube. An elongated plate is within the tube and has opposite ends spaced from the driver. First and second heat exchangers are in proximity to the plate, one at each end thereof. At least one of the heat exchangers comprises a tube bent into a plurality of spaced runs. The tube has an inlet and an outlet spaced therefrom and fins are bonded to the tube in the spaces between the runs.

In a preferred embodiment, the plate is bent in to a plurality of spaced runs with the spacing between the plate runs defining a first free flow area for the gas and wherein the spacing between the tube runs with the fins in place defines a second free-flow area substantially equal to the first free-flow area.

In a highly preferred embodiment, the tube runs are curved and generally concentric.

A highly preferred embodiment of the invention also contemplates that there be two such tubes, each bent in to a plurality of generally concentric, half-circular runs. The inlet and the outlet are common to both of the tubes.

Preferably, the heat exchanger and the core thereof has a depth about equal to the length of the path of movement of a parcel of gas within the resonator tube.

In a highly preferred embodiment, there is provided a thermoacoustic heat transfer apparatus including an elongated, gas-filled resonator tube, at least one acoustic driver associated with the tube for establishing a standing wave therein, an elongated heat transfer stack having opposed ends located within the tube and made up of a plurality of radially spaced layers of a coil of material of relatively poor thermal conductivity. Spacing between the layers defines a free-flow area. A pair of cylindrical heat exchanger cores each include a plurality of curved, concentric runs of flattened tubing adapted to define the liquid side of the heat exchanger, an inlet to the tubing, an outlet from the tubing, the tube runs being separated by fins spanning the spaces and bonded to the tubing such that the area of the space less that occupied by the fins is generally about equal to that of the free-flow area of the stack. Means are provided for mounting one of the cores at each end of the stack within the tube.

Other objects and advantages will become apparent from the following specification taken in connection with the accompanying drawings.

DESCRIPTION OF THE PREFERRED EMBODIMENT

Figure 1:
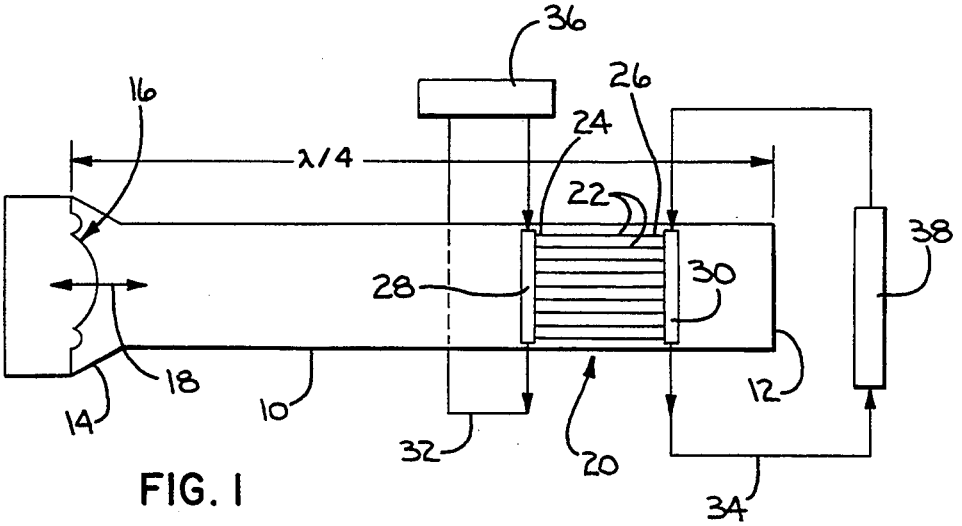
FIG. 1 is a schematic illustration of a simple thermoacoustic heat pump and secondary heat exchangers associated therewith.

A typical thermoacoustic heat pump with which the invention may be used with efficacy is illustrated in FIG. 1. The same includes a resonator tube 10. The resonator tube is filled with a gas, as is well known. Typically, the gas will be an inert gas or a mixture of inert gases and will be at an elevated pressure.

One end 12 of the resonator tube 10 is closed while at the opposite end 14, a driver, generally designated 16 is provided. The driver 16 may be in the form of a bellows or the like and has the effect of sealing the end 14 as well as being driven in a reciprocating fashion in the direction of a bi-directional arrow 18 to generate a standing wave within the tube 10. In essence, the driver 16 may be considered to be a loud speaker and, depending upon the loading on the heat pump, may be operated to produce waves of different amplitude.

In thermoacoustic heat pumps of this sort, the distance from the end 12 to the driver 16 is equal to ¼ of the wave length of the standing wave generated by the driver 16 at a given frequency.

Located within the tube 10 is a so-called "stack," generally designated 20. The stack 20 is formed of one or more layers or plates 22 which are elongated in the direction of the length of the tube 10, that is, elongated from one end 24 to the opposite end 26. The layers are spaced from one another and the space between the layers 22 defines a free-flow area of gas within the tube 10.

As is well known, the stack 20 is made up of a material of low thermal conductivity so that a temperature gradient 10 exists from one end 24 to the other 26.

In the structure illustrated, the end 24 is the cold end of the stack 20 while the end 26 is the hot end. At each of the ends 24 and 26, in abutment with the stack 20, or in extremely close proximity thereto, are primary heat exchangers 28 and 30. The primary heat exchanger 28 is the primary cold side heat exchanger while the heat exchanger 30 is the primary hot side heat exchanger. Structurally, the two may be identical one to the other so only the heat exchanger 28 will be described in greater detail. For present purposes, it is sufficient to note that a heat exchange fluid, typically a liquid, is circulated through each of the heat exchangers 28 and 30 through a flow path 32 and 34 respectively. Within each of the flow paths 32 and 34 is a secondary heat exchanger. The secondary heat exchanger in the flow path 32 is designated 36 and will operate to cool the environment in which it is located.

The secondary heat exchanger associated with the flow path 34 is designated 38 and is operative to reject heat to its environment.

Needless to say, pumps (not shown) may be disposed in each of the flow paths 32, 34 for circulating the heat exchange fluid therein.

Those skilled in the art will recognize that the manner of operation of such a thermoacoustic heat pump is reversible. Consequently, the previous references to hot sides and cold sides and heating and cooling are merely exemplary for one type of operation of the apparatus. It is to be understood that when the apparatus is operated reversibly, those designations will, of course, change from hot to cold and vice versa.

Figure 2:
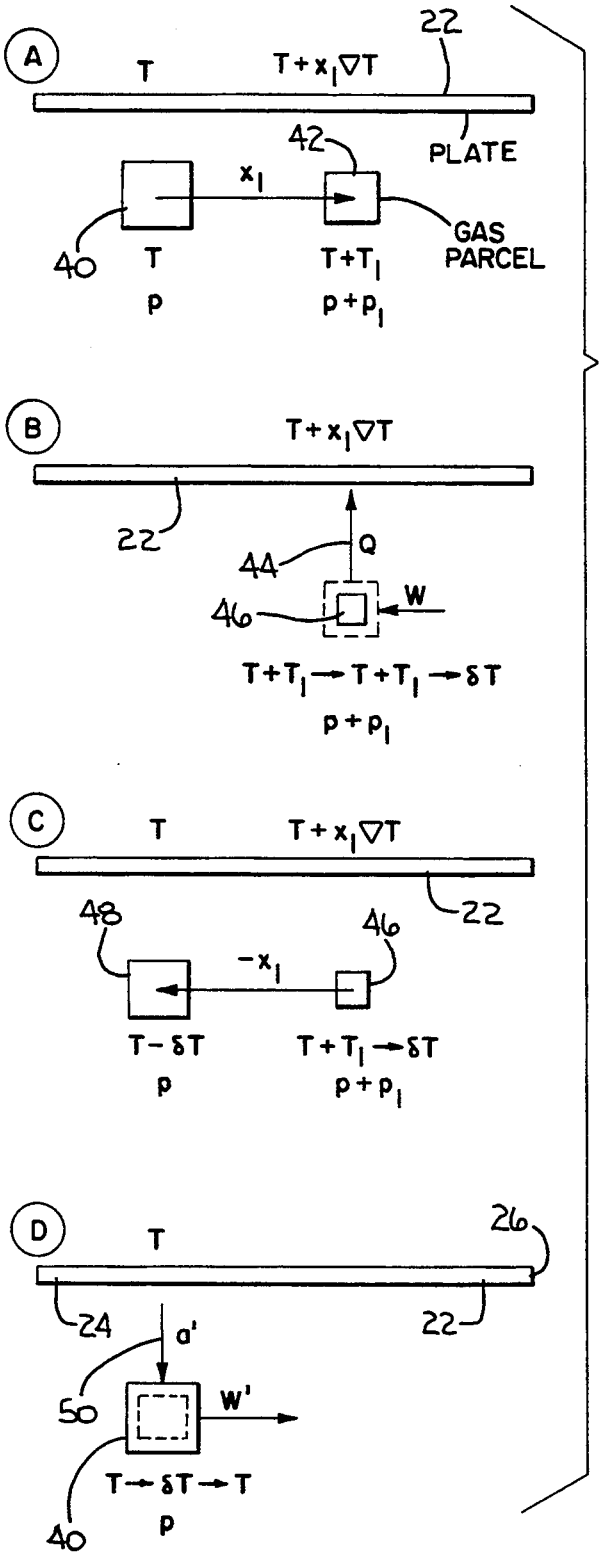
FIG. 2 is made up of FIGS. 2A, 2B, 2C and 2D and are schematic illustrations of the manner of operation of such a heat pump.

A typical cycle is illustrated in FIG. 2. A parcel of gas 40 is adiabatically compressed as the driver 16 (FIG. 1) moves to the right. The gas parcel is moved to the right along the plate and diminished somewhat in volume to appear as at 42 in FIG. 2A. During the adiabatic compression of the parcel 40, its temperature is raised above that of the plate 22 and when moved to the position at 42, the parcel rejects some of its heat to the plate 22. Consequently, the right-hand side of the plate 22 viewed in FIG. 2 will now be at a somewhat higher temperature than the left-hand side.

Rejection of this heat is shown in FIG. 2B as indicated by an arrow 44 and results in a lowering of the temperature of the parcel of gas, now referred to as 46.

At this point in the cycle, the driver 16 will reverse its direction, moving to the left as viewed in FIG. 1 with the consequence that adiabatic expansion of the parcel will occur. Thus, as seen in FIG. 2C, the parcel 46 expands to a volume 48 as it moves to the left. Because the adiabatic expansion started with the parcel 46 at a lower temperature than the parcel 42 due to the heat rejection shown by the arrow 44, when the adiabatic expansion is complete as shown by the parcel 48, it will be at a lower temperature than the parcel 40 was initially. Consequently, the plate 22 will be at a higher temperature than the parcel and heat will be rejected by the plate 22 to the same as indicated by an arrow 50 in FIG. 2D. The parcel will now be just as the parcel 40 and ready to repeat the cycle on the next cycling of the driver 16.

In the context of the showing of FIG. 1, the heat exchange process between the ends 24 and 26 of the stack 20 may be envisioned as a whole train of parcels of gas extending from one end 24 to the other 26 and which all undergo the cycling depicted in FIGS. 2A through 2D. Heat is passed along the stack from one parcel of gas to the next to create a temperature gradient from one end to the other.

Figure 3:
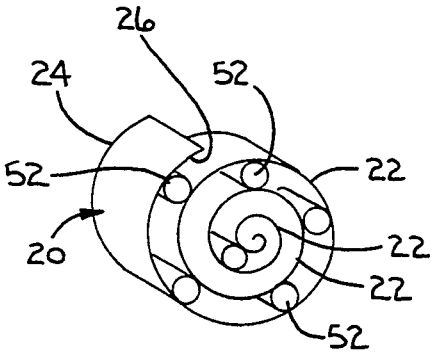
FIG. 3 is a somewhat abbreviated, schematic perspective view of the "stack" employed in a thermoacoustic heat pump.

FIG. 3 shows a typical makeup of the stack 20. In one embodiment, the same may simply be a roll of relatively thin material of low termal conductivity such as mylar film wound spirally about spacers 52 which achieves the desired spacing between the layers 22. In one embodiment, the spacers 52 can be pieces of monofilament fishing line extending longitudinally of the stack so as not to interfere with the flow of the parcels of gas from one end 24 of the stack to the other 26.

Figure 4:
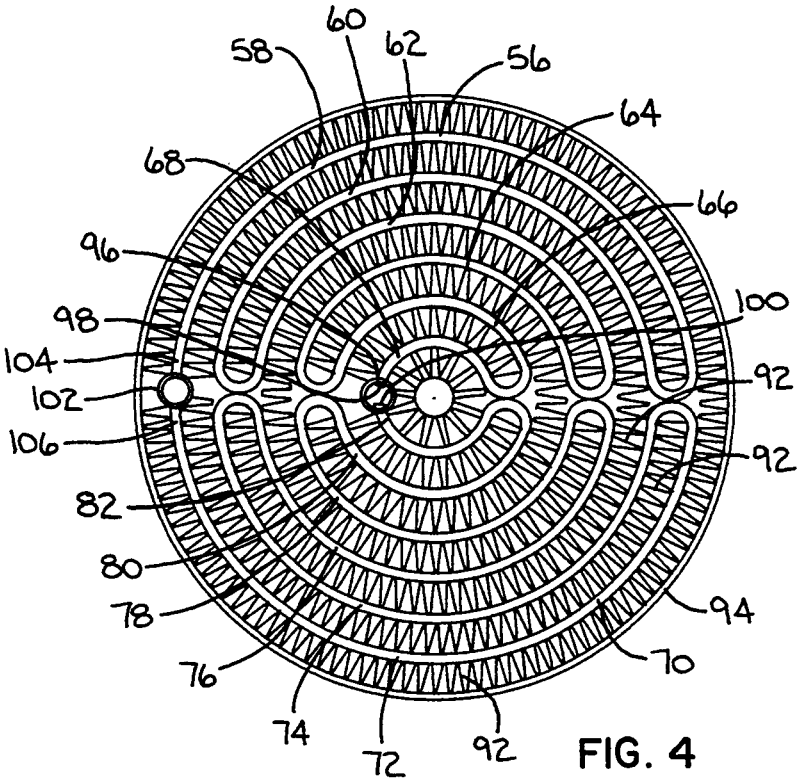
FIG. 4 is a plan view of a primary heat exchanger made according to the invention.
Figure 5:
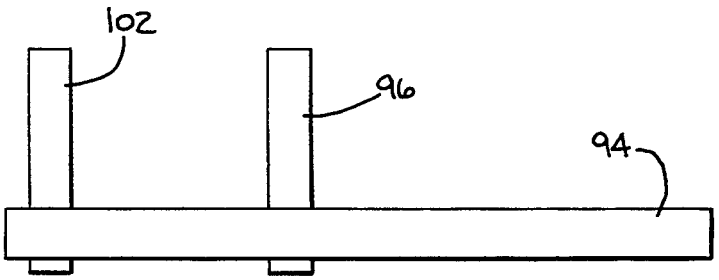
FIG. 5 is a side elevation of the heat exchanger.
Figure 6:
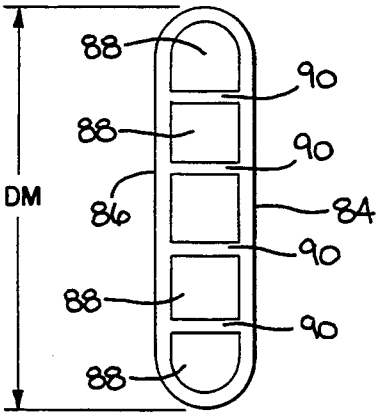
FIG. 6 is a cross-sectional view of tubing employed in the heat exchanger illustrated in FIGS. 4 and 5.

Those skilled in the art will appreciate from the previous description of a typical cycle that parcels of gas at each of the ends 24 and 26 of the layers 22 of the stack will move into and out of the stack as the apparatus cycles. In the context of FIG. 1, these parcels move in and out of respective ones of the primary heat exchangers 28 and 30 to receive or reject heat therefrom as the case may be. FIG. 4 shows a typical one of the heat exchangers. The same is made up of a first flattened tube 56 bent upon itself to form a plurality of runs 58, 60, 62, 64, 66 and 68. Each of the runs is in a half-circle and adjacent runs are spaced from one another. All of the runs are concentric with one another. A second tube 70 is similarly bent upon itself to define runs 72, 74, 76, 78, 80, and 82. Again, the runs are in the form of half-circles which are concentric with one another and spaced from one another. In the usual case, the tubes 56 and 70 will be formed of extruded aluminum tubing having a cross-section shown as illustrated in FIG. 6. Each tube will have opposed flat side walls 84 and 86 with internal flow passages 88 separated from one another by webs 90 which improve the pressure resistance of the tube.

Conventional serpentine fins 92, typically of aluminum, are located in the spaces between the various runs 58, 60, 62, 64, 66, 68, 72, 74, 76, 78, 80 and 82. In addition, the radially outer one of the serpentine fins 92 is confined by a circular hoop 94 as illustrated in FIG. 4.

An inlet tube 96 extends to and is in fluid communication with radially inner ends 98 and 100 of the tubes 56 and 70 respectively. An outlet tube 102 extends to and is in fluid communication with the radially outer ends 104 and 106 of the tubes 56 and 70 respectively. As a consequence of this configuration, two equal length circuits in each of the primary heat exchangers 28 and 30 is defined and because the same are of equal length and are equally and uniformly distributed within a single cylindrical envelope, a more uniform heat flux than would be possible with a single, spirally wound circuit, is achieved.

It is important to note that the spaces between the runs 56, 60, 62, 64, 66, 68, 72, 74, 76, 78, 80 and 82 less that part of such space occupied by the serpentine fins 92 is designed to be approximately equal or just slightly greater than the free-flow area through the stack 20. This relationship allows the quantity of fins 92 to be maximized to improve heat transfer while at the same time, does not amount to a diminishment or a restriction on the area into which the parcels of gas moving off of respective ends 24 and 26 of the stack 20 flows. Such a restriction could impede movement of the gas parcels into and out of the primary heat exchangers 28 and 30, increasing frictional losses and reducing cycle efficiency. In this regard, it should also be noted that the depth of the core of the heat exchanger, that is, the front to back dimension, is essentially defined by the major dimension of the tube as shown in FIG. 6. This dimension is indicated as Dm in FIG. 6 and will typically be chosen to be just slightly greater than the movement from side-to-side undergone by a single parcel in going through the cycle schematically depicted in FIG. 2. A lesser core depth runs the risk of having the parcel move out of the heat exchanger during part of the cycle at which time it is not available to reject heat to the heat exchanger or absorb heat therefrom. Alternatively, if the core depth is made appreciably greater than the degree of movement undergone by a parcel of gas during operation, then the heat exchanger becomes more bulky than is required for optimum heat exchange, frictional losses increase and cycle efficiency decreases.

As alluded to previously, the tubes 56 and 70 typically will be formed of extruded aluminum. However, if desired, they could be fabricated aluminum tubes made according to the teachings of U.S. Pat. No. 4,688,311 issued Aug. 25, 1987 to Saperstein et al. In any event, typically, the fins 92 will also be made of aluminum and as a consequence, it will be appreciated that the heat exchangers 28 or 30 may be easily fabricated by conventional brazing processes well known in the heat exchanger art.

I claim:

1. In a thermoacoustic device, the combination of:
gas filled elongated, resonator tube;
an acoustic driver in said tube for establishing a standing wave therein;
an elongated plate within said tube, said plate having opposite ends spaced from said driver;
first and second heat exchangers in proximity to said plate, one at each end thereof;
at least one of said heat exchangers comprising a tube bent into a plurality of spaced runs;
said tube having an inlet and an outlet spaced therefrom; and
fins bonded to said tube in the spaces between said runs;
said plate being in a plurality of spaced runs, the spacing between said plate runs defining a first-free flow area for said gas; and
the spacing between the tube runs with said fins in place defining a second free-flow area substantially equal to said first free-flow area.

2. The thermoacoustic device of claim 1 wherein said tube runs are curved and generally concentric.

3. The thermoacoustic device of claim 1 wherein there are a plurality of said tubes defining a plurality of generally concentric runs, said inlet and said outlet being common to said plurality of tubes.

4. In a thermoacoustic device, the combination of:
gas filled elongated, resonator tube;
an acoustic driver in said tube for establishing a standing wave therein;
an elongated plate within said tube, said plate having opposite ends spaced from said driver;
first and second heat exchangers in proximity to said plate, one at each end thereof;
at least one of said heat exchangers comprising a tube bent into a plurality of spaced runs;
said tube having an inlet and an outlet spaced therefrom; and
fins bonded to said tube in the spaces between said runs;
said tube runs being curved and generally concentric;
there being two said tubes, each bent into a plurality of generally concentric half-circular runs, said inlet and said outlet being common to said two tubes.

5. A thermoacoustic heat transfer apparatus comprising:
an elongated, gas-filled resonator tube;
at least one acoustic driver associated with said tube for establishing a standing wave therein;
an elongated heat transfer plate within the tube made up of a plurality of spaced layers of material of relatively poor thermal conductivity, the spacing between said layers defining a free flow area;
a heat exchanger core mounted adjacent an end of said plate and including a plurality of runs of flattened tubing adapted to define the liquid side of a heat exchanger;
an inlet to said tubing;
an outlet from said tubing;
said tube runs being separated by spaces; and
fins in and spanning said spaces and bonded to said tubing, the area of said spaces less the area occupied by said fins being generally about equal to or greater than said free-flow area.

6. The heat exchanger of claim 5 wherein said core is generally cylindrical.

7. The heat exchanger of claim 5 wherein said plurality of runs are defined by separate heat exchanger tubes.

8. The heat exchanger of claim 7 wherein said separate heat exchanger tubes share said inlet and said outlet.

9. The heat exchanger of claim 5 wherein said core has a depth about equal to the length of the path of movement of a parcel of gas within said resonator tube.

10. The heat exchanger of claim 5 wherein said runs are curved and concentric to be adapted for use with a plate wherein the layers are radially spaced convolutions of a coil.

11. The heat transfer apparatus of claim 5 wherein the area of said spaces less the area occupied by said fins is generally about equal to or just slightly greater than said free-flow area.

* * * * *